US007301508B1

(12) United States Patent
O'Loughlin

(10) Patent No.: US 7,301,508 B1
(45) Date of Patent: Nov. 27, 2007

(54) OPTIMIZATION OF NEAR FIELD ANTENNA CHARACTERISTICS BY APERTURE MODULATION

(75) Inventor: James P. O'Loughlin, Placitas, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 11/539,886

(22) Filed: Oct. 10, 2006

(51) Int. Cl.
*H01Q 15/20* (2006.01)
*H01Q 19/12* (2006.01)

(52) U.S. Cl. ..... 343/912; 343/914

(58) Field of Classification Search ..... 343/840, 343/912–916
See application file for complete search history.

(56) References Cited

U.S. PATENT DOCUMENTS 4,571,594 A * 2/1986 Haupt ..... 343/840
4,750,002 A * 6/1988 Kommineni ..... 343/915
4,845,510 A * 7/1989 Chang et al. ..... 343/880
5,307,082 A * 4/1994 Silverberg ..... 343/915

OTHER PUBLICATIONS

USAF Active Denial Technology, http://deps.org/news/active_denial_tech.doc.

* cited by examiner

*Primary Examiner*—Michael C. Wimer
(74) *Attorney, Agent, or Firm*—Kenneth E. Callahan

(57) ABSTRACT

The approximate radius of curvature of the spherical phase front at the aperture of a transmitting microwave antenna is controlled by an inner section of the aperture attached to the outer section of the aperture by a small number of programmable transducers, thereby controlling the near field shape and power distribution of the transmitted beam.

3 Claims, 14 Drawing Sheets

Radial Beam Distance for normalized focal lengths of 0.05, 0.10, 0.15, 0.20, and 0.25 Rnf Normalized Power Density for Focal Lengths of -Rnf, -3*Rnf, -5Rnf, and Infinite Normalized Power Density for Focal Lenghts of 0.25 Rnf, 0.5 Rnf, 1.0 Rnf, 2.0 Rnf, 100 Rnf $$P(v,w) := \left| \int_{-\pi}^{\pi} \int_{0}^{R(\theta)} PN \cdot \frac{e^{i \cdot k \cdot \Delta AT}}{\Delta AT} \, r \, dr \, d\theta \right|^2$$

$$P(v,w,R) := PN\cdot\left[\int_0^{\frac{D1}{2}}\int_{-\pi}^{\pi}\frac{e^{-1i\cdot k\cdot\left[\left[(R-\Delta ps)^2+(r\cdot\cos(\theta)-v)^2+(r\cdot\sin(\theta)-w)^2\right]^{\frac{1}{2}}\right]}\cdot r}{\left[(R)^2+(r\cdot\cos(\theta)-v)^2+(r\cdot\sin(\theta)-w)^2\right]^{\frac{1}{2}}}\,d\theta\,dr+\left[\int_{\frac{D1}{2}}^{\frac{D}{2}}\int_{-\pi}^{\pi}\frac{e^{-1i\cdot k\cdot\left[\left[(R)^2+(r\cdot\cos(\theta)-v)^2+(r\cdot\sin(\theta)-w)^2\right]^{\frac{1}{2}}\right]}\cdot r}{\left[(R)^2+(r\cdot\cos(\theta)-v)^2+(r\cdot\sin(\theta)-w)^2\right]^{\frac{1}{2}}}\,d\theta\,dr\right]\right]^2$$

FIG. 11

OPTIMIZATION OF NEAR FIELD ANTENNA CHARACTERISTICS BY APERTURE MODULATION

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

This invention relates generally to the field of antennas and more specifically provides a means of control and optimization of the near field behavior of a microwave transmitting antenna.

Microwave transmitting antennas of the aperture type or equivalent operating at millimeter wavelengths have an equivalent aperture diameter that is many wavelengths that defines a near field region extending as far as hundreds of meters. The near field range (Rnf) of an antenna is defined as a range that is less than $Rnf \approx D^2/\lambda$. This is referred to as the near field boundary. D is the equivalent diameter of the antenna and A is the wavelength, all quantities being in meters. For example, an antenna with a diameter of 1 meter, at a wavelength of 0.003 meters (i.e. 100 GHz), the near field boundary is 333.33 meters. At ranges greater than the near field boundary, i.e. in the far field region, the behavior of the beam formed by the radiation from the antenna is well defined and has an intensity that falls off as the inverse square of the range. Most microwave systems, such as radar and communications, operate over ranges that are exclusively in the far field and near field performance is not a consideration.

There are systems that operate in the near field, such as Active Denial Technology (ADT). In the near field the shape and power density distribution of the radiated beam is complicated and changes considerably as a function of range, aperture shape, focal length, illumination amplitude and phase distribution.

An aperture antenna is one that has an aperture through or from which the electromagnetic fields pass to form a radiate beam or field. Any antenna can be described in terms of an equivalent aperture, thus in general the aperture concept is very broad. To simplify much of the analysis a circular aperture antenna is used to explain the qualitative performance characteristics in a somewhat general manner. However, the shape of the aperture does have an important impact in the near field and will be dealt with as required. Unless otherwise stated, an aperture of diameter D operating at a wavelength $\lambda$ is used as the basis of analysis. In addition to the shape, wavelength, and diameter, the aperture also has another attribute, focal length, f. The focal length is defined as the radius of curvature of the spherical phase front at the aperture.

For the applications under consideration it is desirable to provide a nearly uniform power density distribution, bounded by a minimum and maximum level, over a target area for a continuous variation of range from a few meters from the antenna to a maximum of tens or hundreds of meters. The near field power density of a circular aperture with uniform illumination has a peak on boresight at a typical normalized range on the order of Rnf/6 to Rnf/4 depending primarily on the focal length and shape of the aperture. The first peak of the power intensity on boresight, as the range is decreased from the near field boundary is called the Fresnel maximum. This characteristic is illustrated in FIG. 1. The radial power intensity of the spot is illustrated in FIG. 2. As the focal length is reduced, the power density peak rises and the range of the peak decreases. At ranges closer than the Fresnel maximum peak the power density on boresight has numerous nulls and the shape of the "spot" develops various patterns of rings. As the range increases beyond the Fresnel maximum the "spot" has a central concentration and gradually transitions into the far field where the power density falls off as the inverse square of the range.

When the focal length is made negative, that is the radius of curvature of the phase front is convex instead of concave, the behavior of the normalized boresight power density behaves as shown in FIG. 3. As expected, the power is dispersed by the convex phase front and, as shown in FIG. 3, the power density becomes lower as the negative focal length becomes more convex. When the focal length is negative, as in FIG. 3, the far field performance is seriously degraded. Thus, one would never use a negative focal length for a far field application.

The complexity of the "spot" power density distribution in the near field is illustrated in FIG. 2. The power density of a circular aperture with an infinite focus is plotted as a function of the radial distance from boresight for normalized ranges (R/Rnf) of 0.05, 0.10, 0.15, 0.20 and 0.25. Because of the circular symmetry, the beam profile is a figure of revolution of the plots shown in FIG. 2. The pattern of the power density in the beam is quite variable as a function of range. In addition, for all ranges the total power of the beam is confined to about the same outer diameter although the distribution is non-uniform.

These characteristics are not ideal for applications that require a concentration of the beam power that is confined to an area and does not vary greatly in magnitude over the concentration area. It is desirable to have control of the spot characteristics. In principle it is computationally possible to program the focal length of the aperture such that a more uniform power density distribution is achieved at selected ranges. This is very difficult to implement in that it would require an aperture phased array of hundreds of thousands of elements or a precisely mechanically deformable aperture. Neither of these options is feasible as a practical matter.

How to accomplish a more uniform power density distribution and control of the spot characteristics in the near field region using a practical approach is the subject of the present invention.

SUMMARY

Aperture type microwave transmitting antennas are usually designed for far field operation. However, there are systems designed for near field operation, such as active denial technology. The shape and power density distribution of the radiated beam in the near field is complicated and varies considerably as a function of range, aperture shape, focal length, illumination, and phase distribution. While it is computationally possible to program the focal length of the aperture to achieve a more uniform power density distribution at selected ranges within the near field, it has heretofore required an aperture phased array of hundreds of thousands of elements or a precisely mechanically deformable aperture.

An embodiment of the present invention provides a simple and inexpensive means for controlling the near field (Fresnel zone) characteristics of microwave transmitting antennas. The antenna aperture is divided into two sections with the inner section connected to the outer section by a small number of transducers that can be individually driven by a programmable driver. The transducers are used to vary the relative position of the inner section of the antenna aperture with respect to the outer section of the antenna aperture, approximating a concave or convex shape. Controlling the effective radius of curvature of the spherical phase front (focal length) at the antenna aperture controls the spot characteristics within the near field of the antenna. Furthermore, this embodiment can also vary the tilt angle of the inner section to control the off axis position of the radiated beam or to trace out a scan pattern.

BRIEF DESCRIPTION OF THE DRAWINGS

FIG. 11 is the general equation for the calculation of the power density due to radiation from the aperture antenna of FIG. 5.

DESCRIPTION OF THE PREFERRED EMBODIMENT

The near field of an aperture antenna is comprised of a non-radiating reactive region in the space immediately surrounding the antenna and the radiating near field region referred to as the Fresnel region, the region of primary interest in the following discussion. This region extends from the outer boundary of the reactive region given approximately by:

$$R_{rr}<0.62\sqrt{(D^3/\lambda)}$$

where D is the largest dimension of the antenna and λ is the transmitting wavelength. The outer boundary of the Fresnel region is approximately given by:

$$R_{nf}\approx D^2/\lambda$$

which for the earlier example would give an approximate range of 11 to 333 meters.

It has been shown above that conventional aperture antennas have non-uniform power density distributions in the near field region and are, therefore, poor in performance for applications that require a concentrated beam that is reasonably uniform over the beam area. It has also been shown that if one can control the focal length or the radius of curvature of the phase front on the array, the spot characteristics can be controlled at ranges within the near field of the aperture. This type of application requirement can be satisfied if the power intensity profile can be modulated such that the average power over the beam diameter is constant even if the instantaneous profile has non-uniform variations. This is based on the thermal time constant of the target being longer than the modulation rate of the power intensity profile and providing the averaging function.

Figure 2:
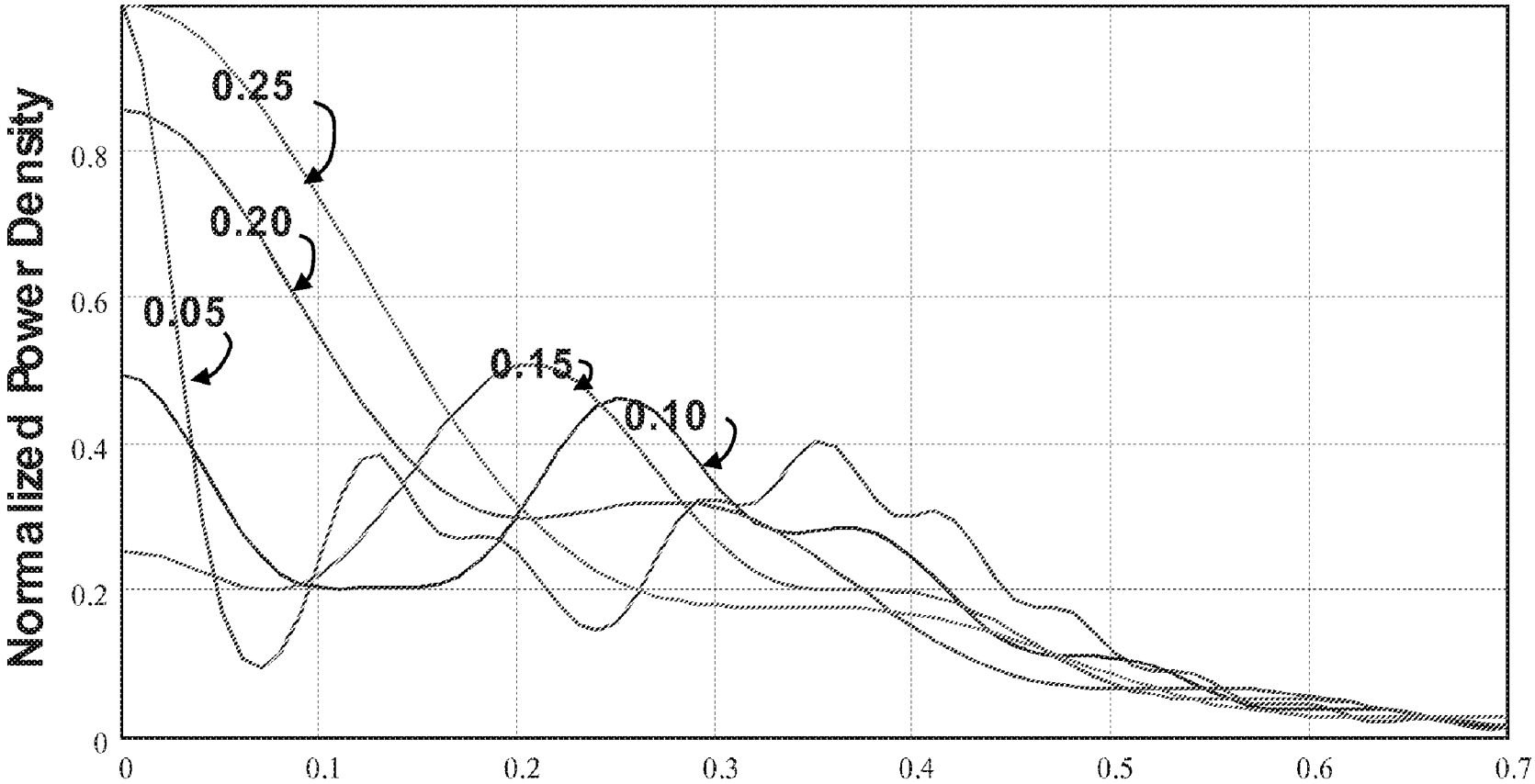
FIG. 2 is a plot of normalized power density vs. radial beam distance for normalized ranges of 0.05, 0.10, 0.15, 0.20 and 0.25 Rnf, focal length is infinite.
Figure 3:
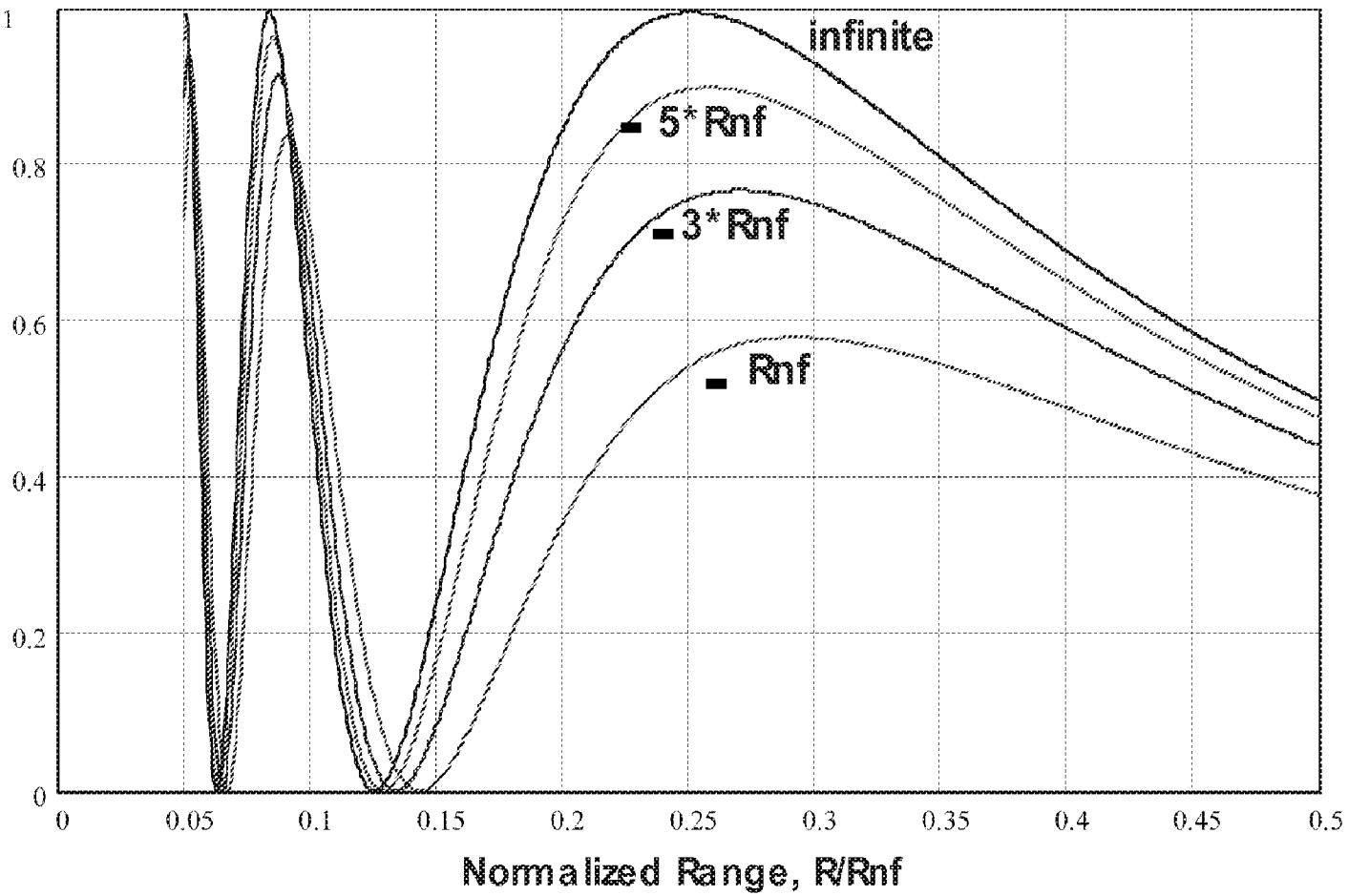
FIG. 3 is a plot of normalized boresight power density of a circular aperture vs. normalized range for normalized focal lengths of −1.0, −3.0, −5.0 (Rnf) and infinite.
Figure 4:
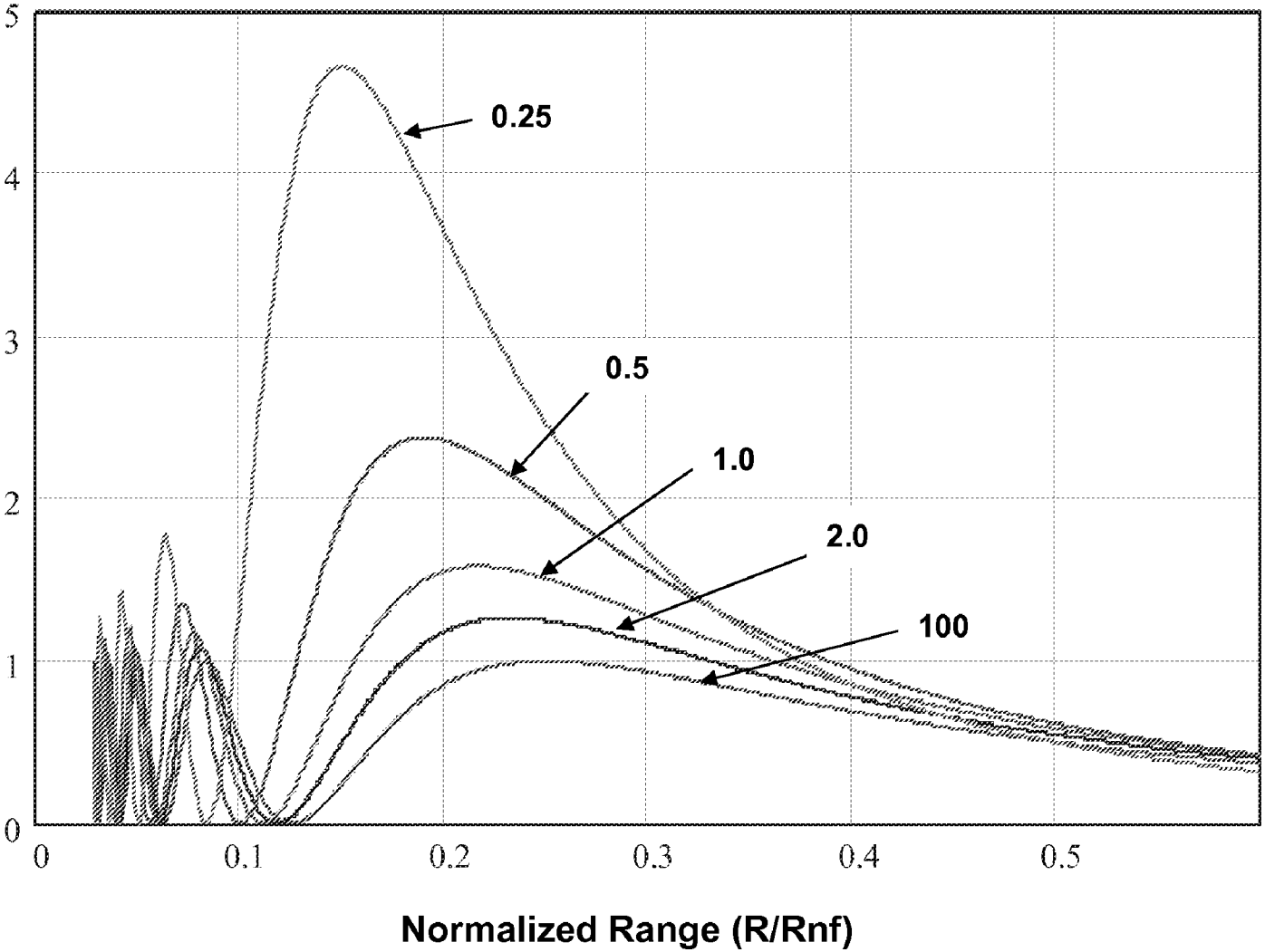
FIG. 4 is a plot of normalized boresight power density of a circular aperture as a function of normalized range for normalized focal lengths of 0.25, 0.5, 1.0, 2.0 and 100 (Rnf).

The invention provides for this type of modulation in addition to the capability of controlling the steady spot characteristic. As illustrated in FIG. 2, FIG. 3, and FIG. 4, it is possible to modulate the power density and beam profile by varying the radius of curvature of the phase front at the aperture. To accomplish this precisely is a difficult and costly task to implement. Precise implementation would require an aperture antenna fabricated from hundreds of thousands of individual phase controlled elements or a precision physically deformable aperture. The phased array approach is costly and prohibitively complex. The implementation of a precisely mechanically deformable aperture is also a very difficult and complex task. However, analysis shows that a simple approximation of the phase front radius of curvature modulation produces the desired effect as well as the precisely modulated phase front radius of curvature modulation.

Figure 5:
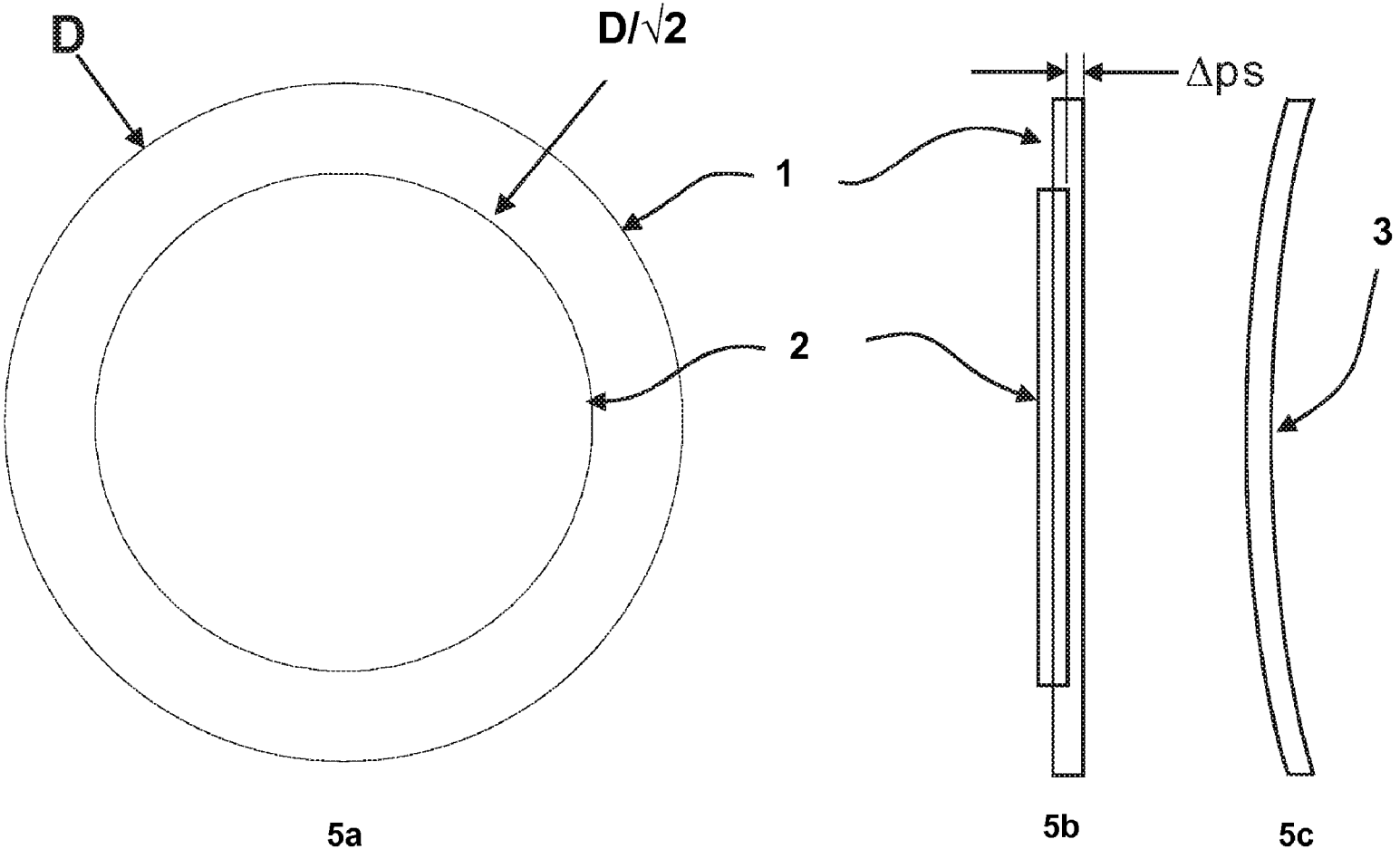
FIG. 5 shows three views of a circular aperture with a movable center section.

This approximate method of modulating the phase front radius is very easily implemented and is the basis of the invention. To explain, consider a circular aperture that is divided into two sections, an aperture plate 1 of diameter D is fixed at its outer rim and a moveable central section 2 of diameter $D/\sqrt{2}$, as in FIG. 5. The aperture antenna may be of any type that is illuminated externally or internally and emits a phase front to form a beam. For simplicity of explanation a flat aperture with an infinite focus is assumed. The center section 2 of the aperture 1 is such that it may be displaced normal to the plane of the aperture plate 1. In the initial resting position the center section 2 is in the same plane as the outer fixed part of the aperture plate 1 and the effective radius of curvature is infinite. When the central part 2 of the aperture is displaced to the left, as shown in FIG. 5*c*, the surface of the aperture plate 1 approximates a convex shape 3.

When the center section 2 is displaced by various amounts in terms of fractions of a wavelength, λ, of the operating frequency, the phase of the radiation from the aperture surface 3 is shifted. This shift changes the radiation characteristics from those experienced when there is no shift or equivalently when the aperture consists of a single uniform flat disc.

Figure 6:
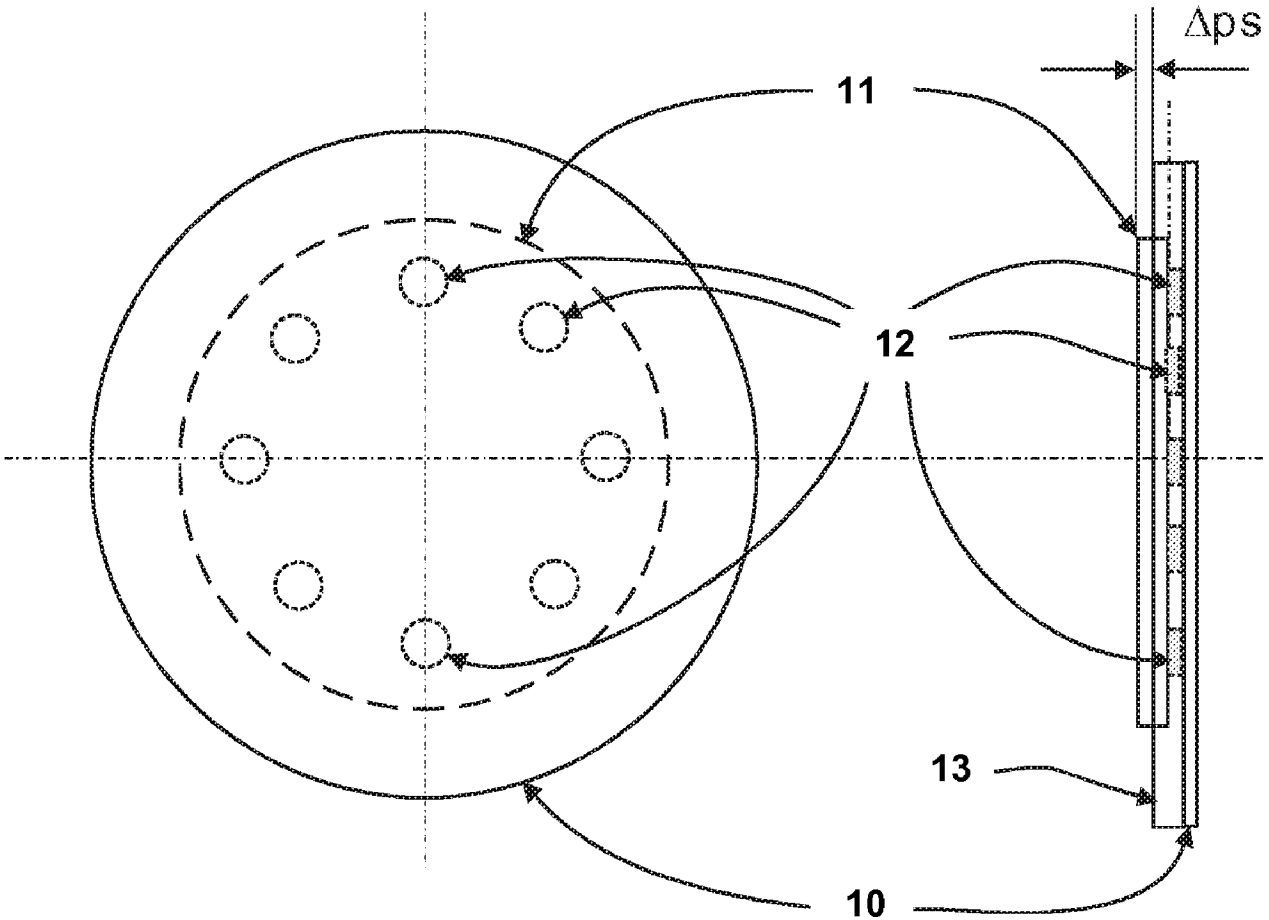
FIG. 6 is a diagram of a possible embodiment of the invention having two concentric disc apertures with the inner disc being displaced from the outer disc by means of transducers.

One implementation of the invention is achieved by placing transducers 12 around the center disc 11 of the antenna assembly as shown in FIG. 6. The transducers 12 are mounted on the central disc 11 and attached to the aperture plate 10. The center disc 11 is itself attached to a frame 13 that is connected to the outer ring of the antenna plate 10. The transducers 12 may be piezoelectric, electromagnetic, or any other suitable type. The maximum throw of the transducer, Δps, should be a maximum of about one wavelength, or about 3-mm at a frequency of 100 GHz.

Figure 7:
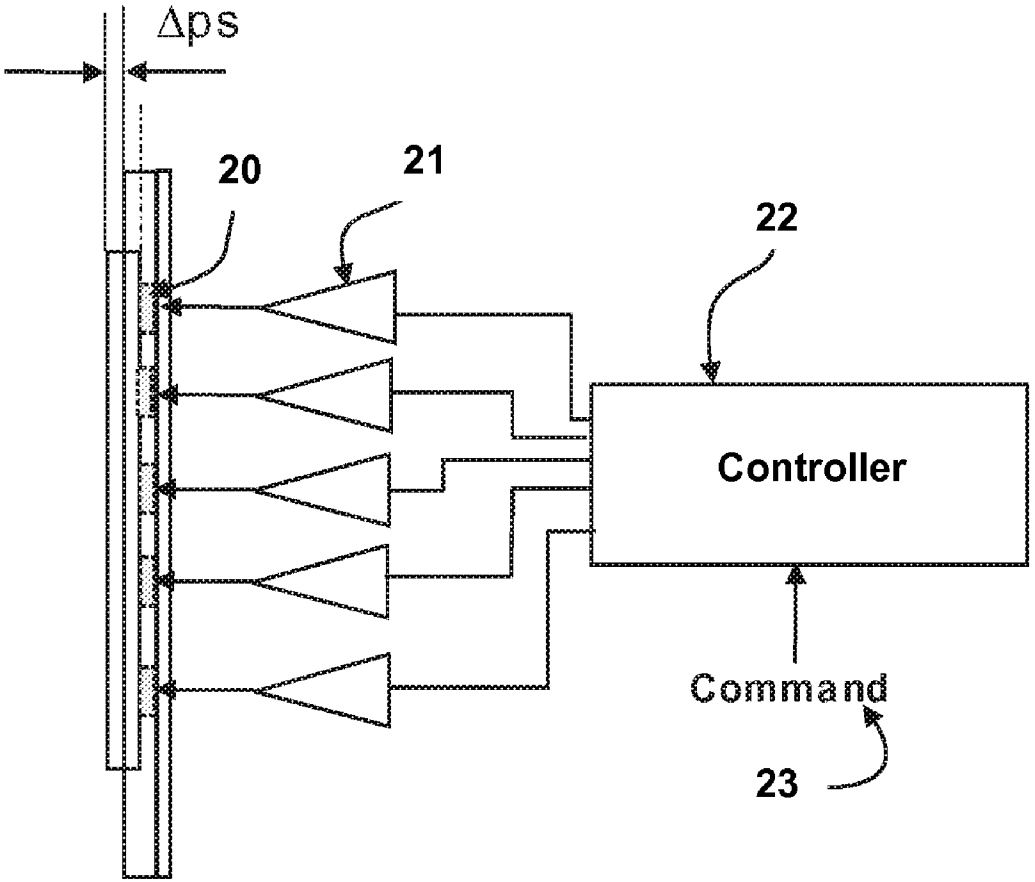
FIG. 7 is a diagram showing a typical arrangement for controlling the transducers of FIG. 6.

In FIG. 7, the transducer drive amplifiers 21 are programmed by a controller 22 that receives commands 23 from a system computer, operator or some appropriate source, and determines the displacement, Δps, based on a look up file, which is included in the controller 22, relating the spot characteristic to the range of interest.

Figure 8:
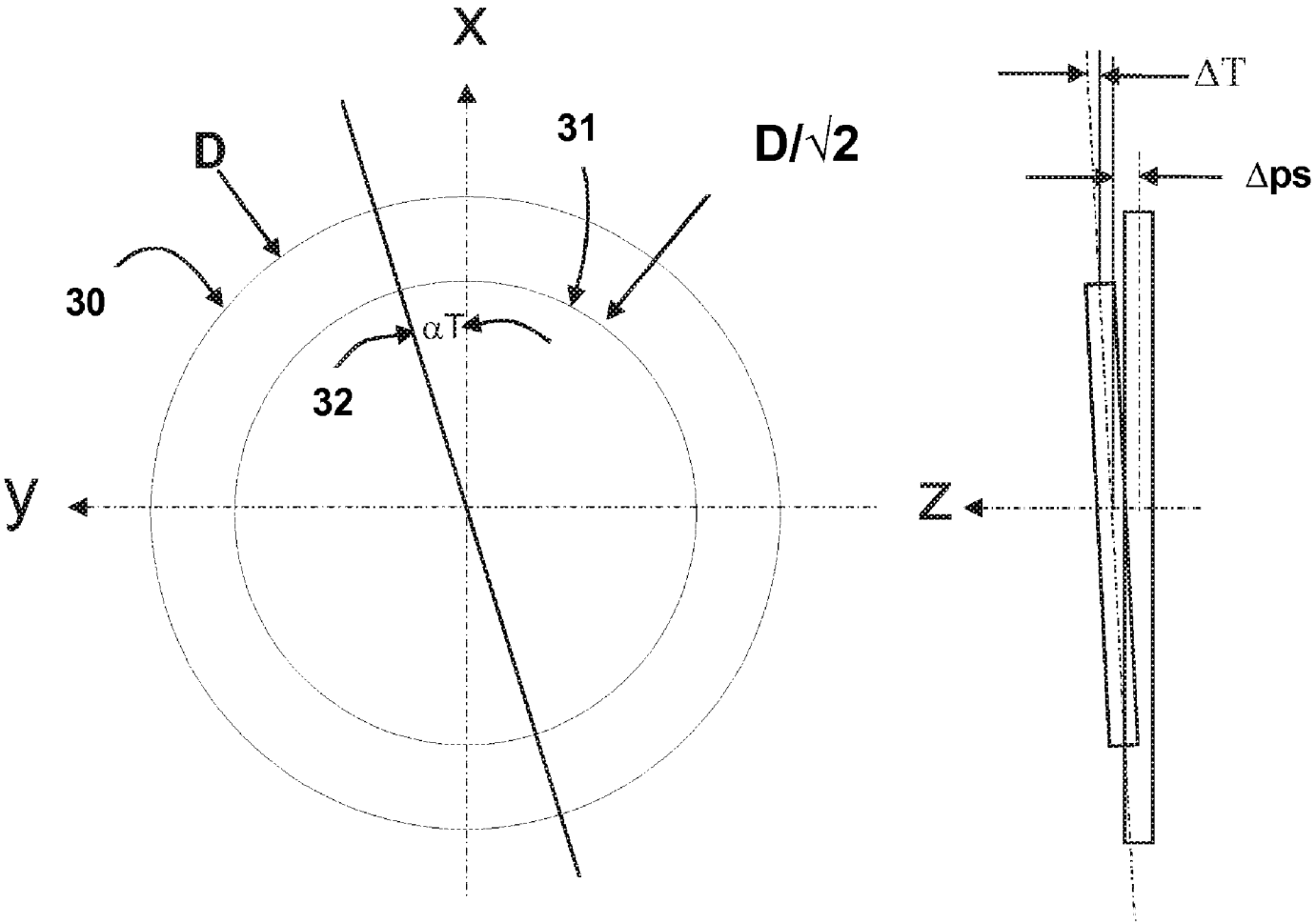
FIG. 8 is a diagram showing the ability to tilt the center disc and to vary the angular position of the maximum tilt.

As shown in FIG. 8, in addition to implementing a linear displacement, Δps, of the inner central disc 31 normal to the plane of the aperture plate 30, the transducers may also be programmed to provide a tilt, ΔT, to the central disc 31. Furthermore, the axis of the tilt 32 may be controlled to assume any orientation or to vary in time. This would permit the transmitted beam to point off axis or to trace out a scan pattern.

Figure 9:
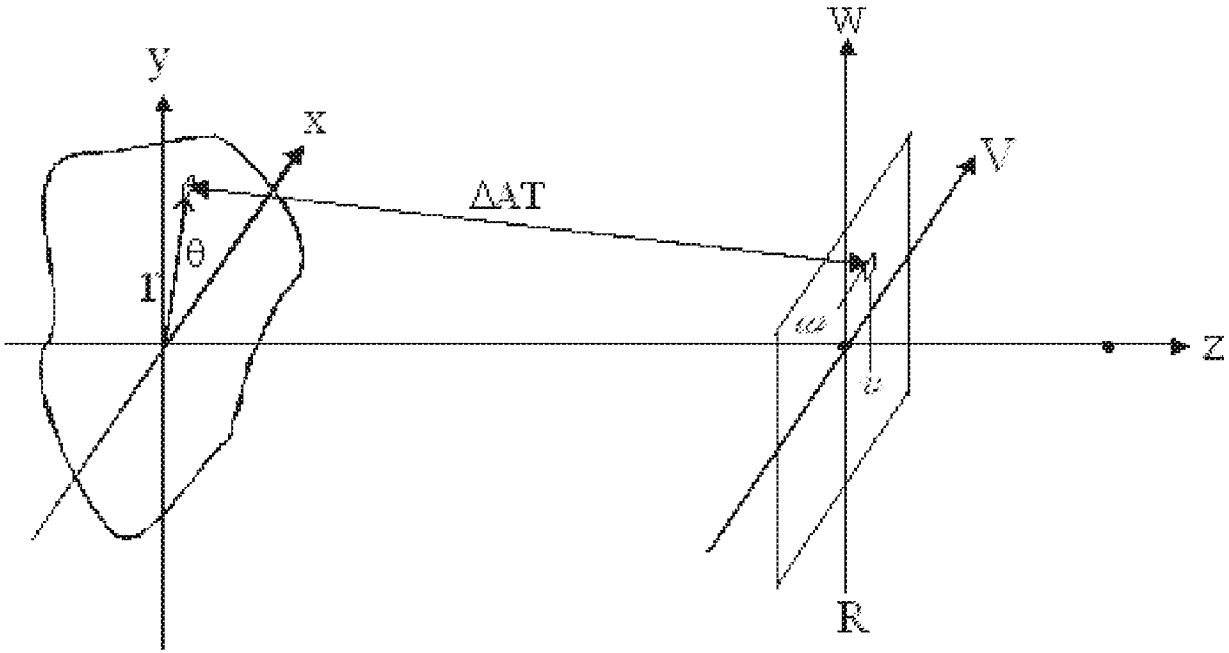
FIG. 9 is a diagram and general equation for calculation of the power density due to radiation from an aperture antenna.

The resulting characteristics of the displacements and tilts are analyzed in the following paragraphs. The power density at a point in a target plane at range can be calculated using scalar potential theory. The general case equation and geometry are shown in FIG. 9. The equation in FIG. 9 assumes that the aperture is uniformly illuminated. This equation can be adapted to any shape aperture and also for non-uniform illumination by those skilled in the art.

In FIG. 9 the geometry has been adapted to the geometry of an embodiment of the invention as shown in FIG. 5. The equation of FIG. 9 has been likewise adapted (see FIG. 10) to the geometry of the FIG. 5 embodiment.

Figure 10:
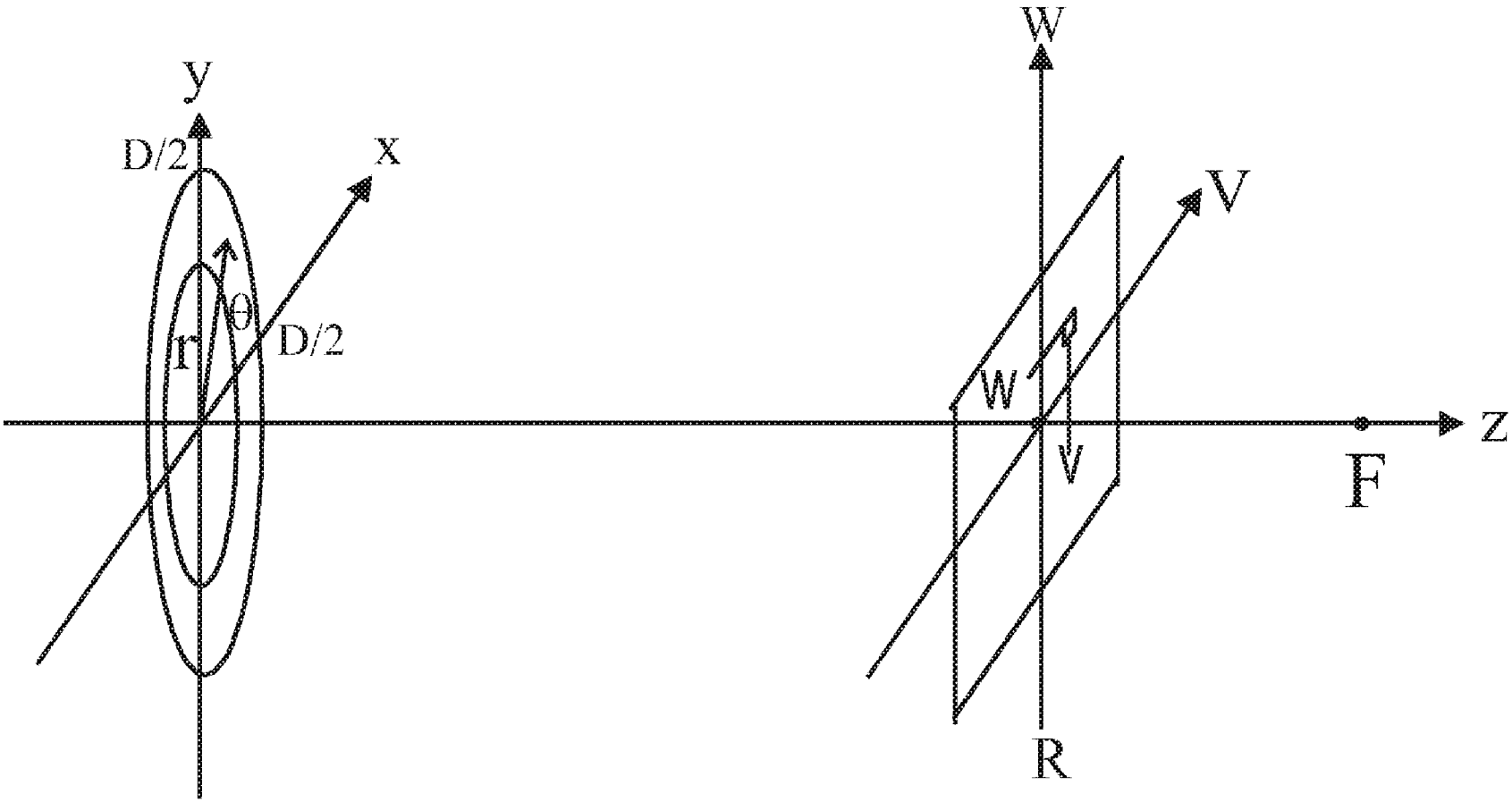
FIG. 10 shows the geometry for the calculation of the power density due to radiation from the aperture antenna of FIG. 5.

The over all coordinate system of FIG. 10 is x-y-z. The aperture calculations are in polar coordinates because of the circular symmetry. The computations in the target plane are in Cartesian coordinates referred to the v-w plane. Referring to the equation of FIG. 11, D=diameter of the outer disc; D1=diameter of the inner disc; Δps is the displacement of the inner disc from the outer disc; and PN=scaling factor to relate the power density on the aperture to the field point. Using the FIG. 11 equation, the power density profiles of the beam may be calculated for any displacement, Δps, and at any range R.

Figure 1:
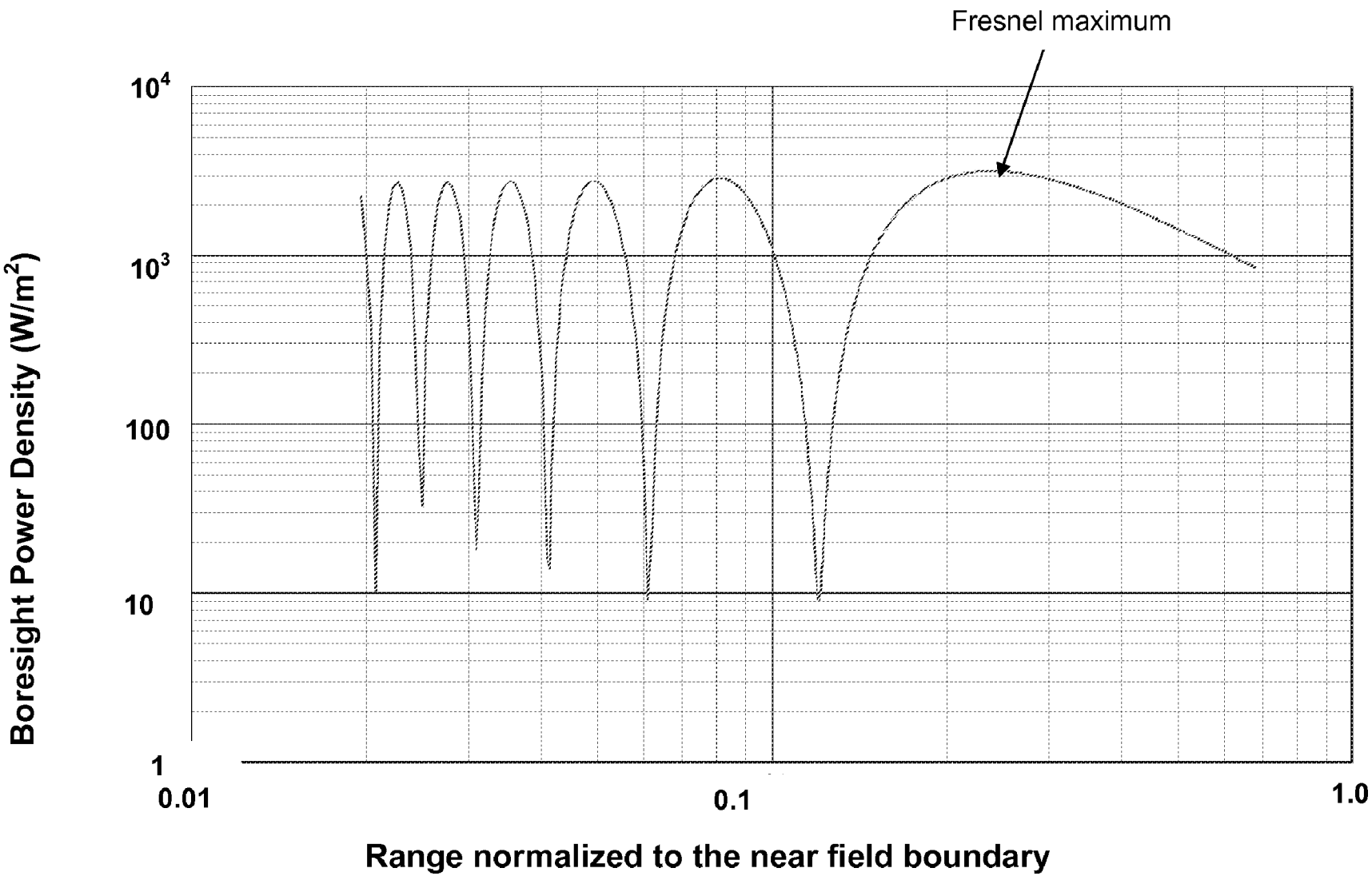
FIG. 1 is a plot of the boresight power density ($W/m^2$) vs. range normalized to the near field boundary of a disc aperture as in FIG. 4 with zero displacement of the inner disc.

For reference purposes the boresight power density is shown in FIG. 1 with the central disc (2 of FIG. 5) having zero displacement. In FIG. 11 the range is normalized to the near field boundary ($NFB=D^2/\lambda$), the frequency is 100 GHz, the outside diameter of the aperture plate is 1 meter, the inner disc diameter is 0.707 m, and the power is 1-kW with uniform illumination.

The first maximum encountered as the range decreases from the far-field region (at a normalized range of about 0.25 in the FIG. 1 plot) is commonly referred to as the "Fresnel maximum". The transition between near-field and far-field takes place between this maximum and the normalized range of 1.0.

Figure 12:
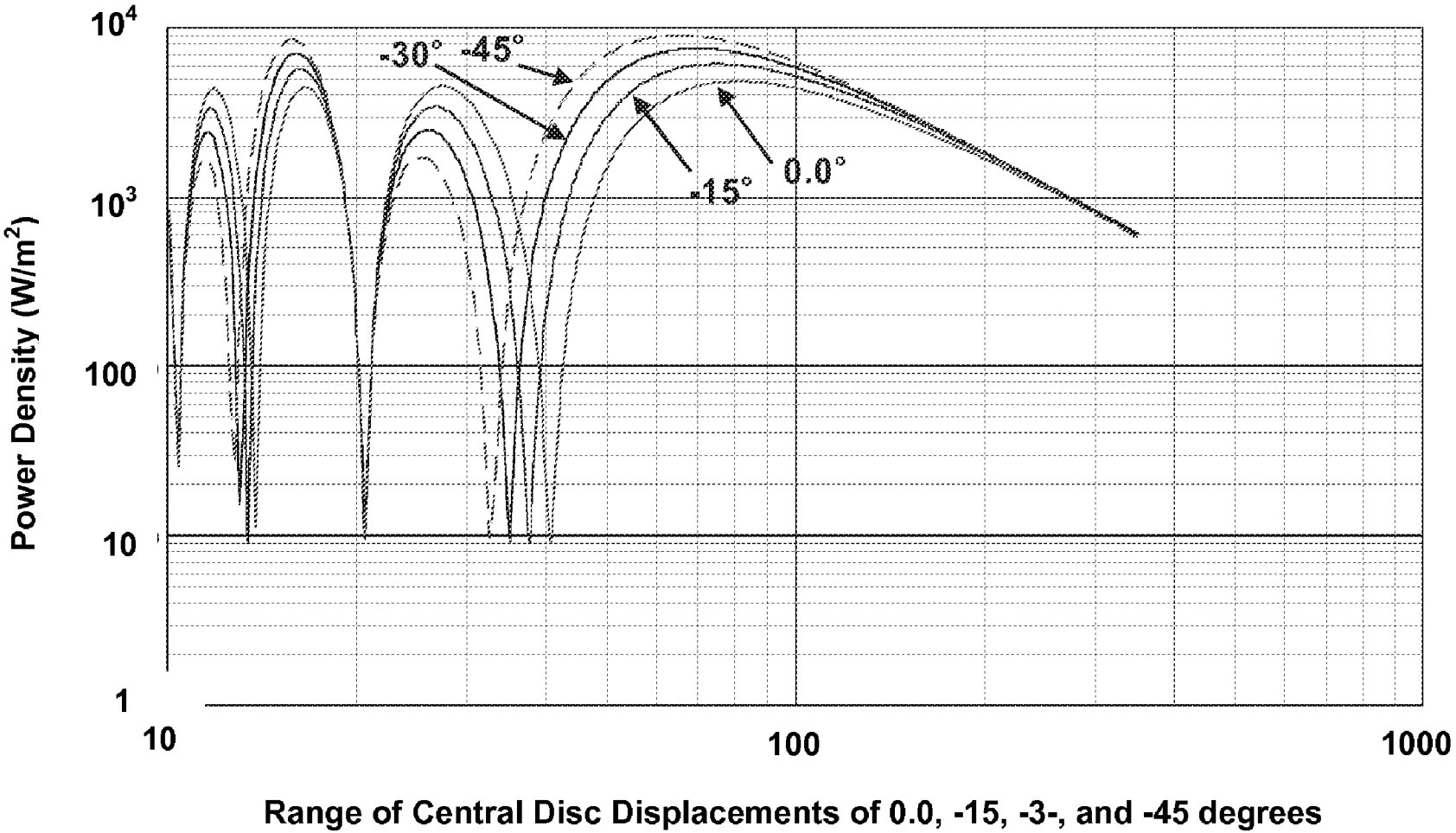
FIG. 12 is a plot of the boresight power density ($W/m^2$) vs. range for central disc displacements of 0, −15, −30, and −45 degrees.

When the displacement Δps, expressed in equivalent degrees, (see FIG. 12) is negative, the effect is that of decreasing the focal length of the aperture, or equivalently, a concave curvature of the phase front (aperture plate concave curvature). As the displacement Δps becomes increasingly negative, the boresight Fresnel peak amplitude increases and moves closer in range to the aperture, as shown in FIG. 12. This is equivalent to decreasing the focal length, f, of the aperture. This is verified by comparison with FIG. 3. FIG. 12 is a plot of the boresight power density ($W/m^2$) vs. the range for central disc displacements of 0.0, −15, −30, and −45 degrees based on λ=360 degrees. The frequency is 100 GHz, the outside diameter is 1 meter, the disc diameter is 0.707 m, and the power is 1-kW with uniform illumination for this figure.

When the displacement is positive it approximates distorting the phase front in a convex manner. Intuitively one might think that this would disperse the beam power and the boresight intensity would fall off at all ranges as the convex curvature increased. This is true in the far field. The Fresnel maximum is also affected in that it decreases in amplitude and moves out in range. However, the first maximum to the left of the Fresnel peak increases in amplitude and also moves out in range.

Figure 13:
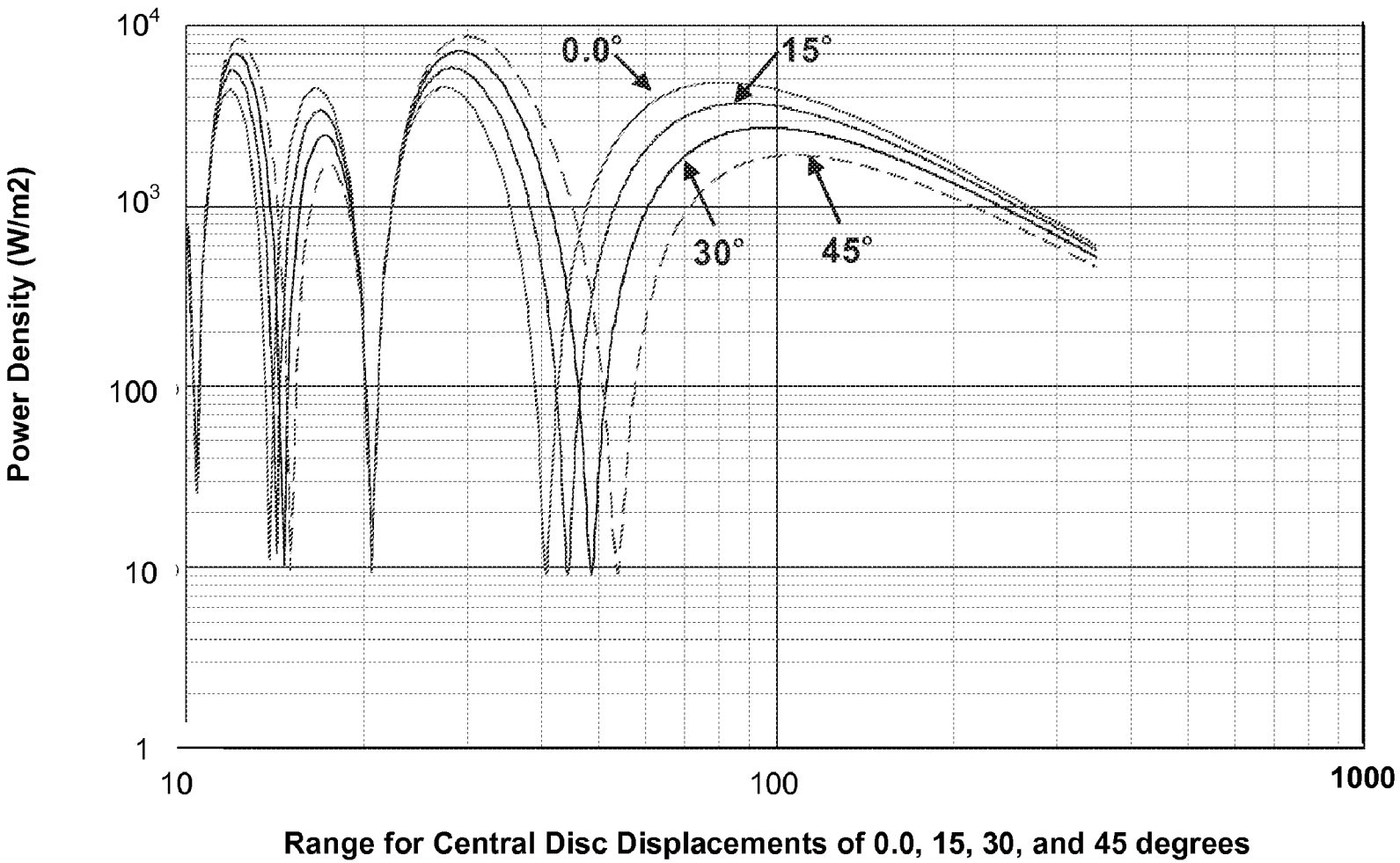
FIG. 13 is a plot of the boresight power density ($W/m^2$) vs. range for central disc displacements of 0, 15, 30, and 45 degrees.

When the displacement, Δps, of the inner disc is positive the result is the approximation of a convex phase front (aperture plate convex curvature). This behavior is shown in FIG. 13 for positive displacements of the inner disc that result in an approximate convex phase front. Comparing FIG. 13 to FIG. 2, the behavior is similar in that when there is a decrease in the focal length or precise radius of curvature as in FIG. 2, or a decrease in the approximate focal length as in FIG. 13. That is, the Fresnel peak moves inward in range and increases in amplitude. And, the first peak to the left of the Fresnel peak moves inward in range and decreases in amplitude. Therefore, in terms of effect, the disc movement or modulation in this embodiment of the invention is essentially equivalent to that of a precisely shaped radius of curvature.

The effect of varying the displacement Δps in the positive direction is shown in FIG. 13. The Fresnel maxim shifts to the right and decreases the amplitude. Also, the amplitude peak to the left of the Fresnel peak grows in amplitude and shifts slightly to the right. The effect is equivalent to that shown in FIG. 3 where the focal length is negative. FIG. 13 is a plot of the boresight power density ($W/m^2$) vs. the range for central disc displacements of 0.0, 15, 30, and 45 degrees based on λ=360 degrees. The frequency is 100 GHz, the outside diameter is 1 meter, the disc diameter is 0.707 m, and the power is 1-kW with uniform illumination for this figure.

Figure 14:
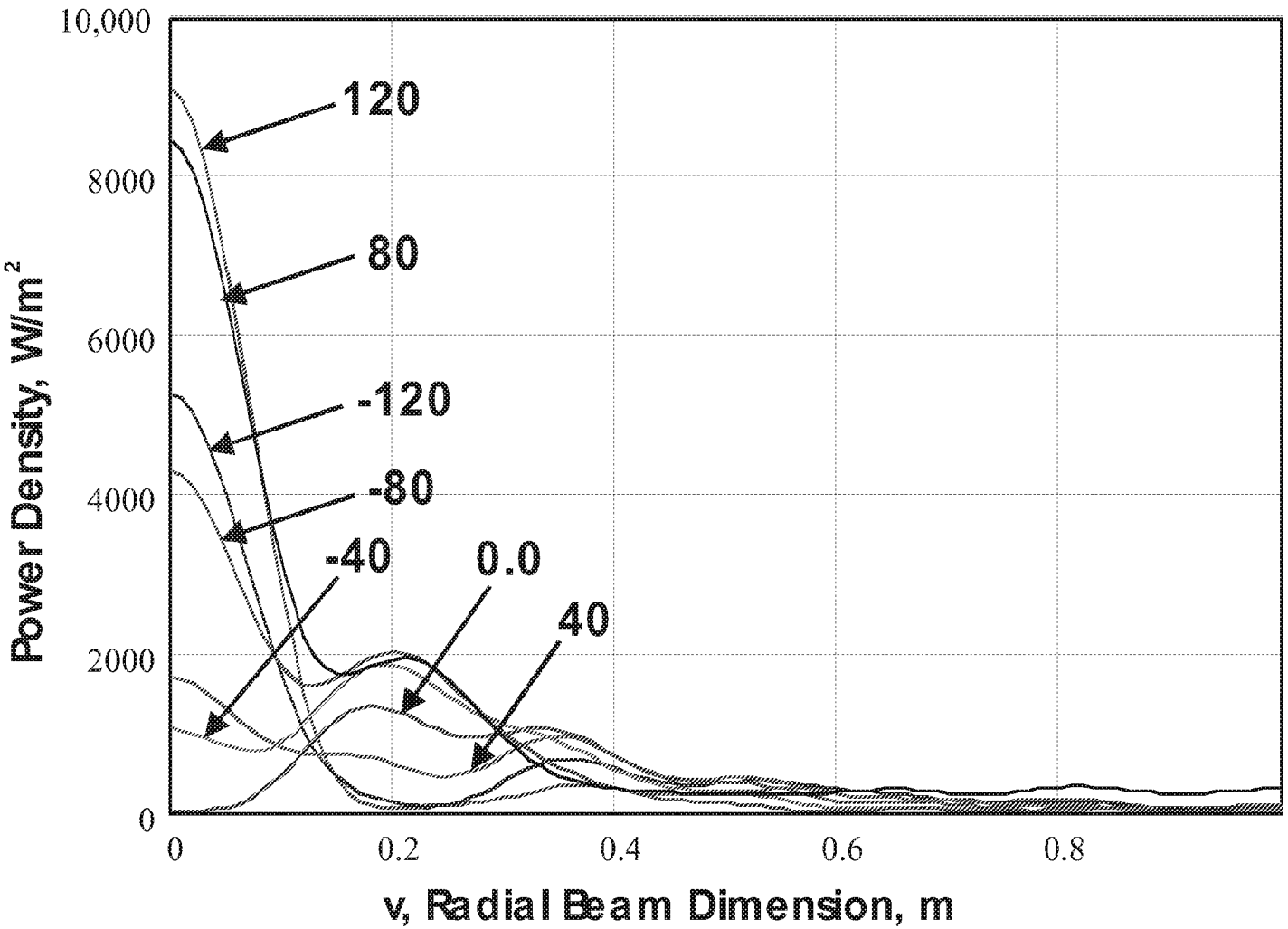
FIG. 14 is a plot showing the radial power profile at a range of 60 meters for inner disc displacements ranging between ±120 degrees, referred to a wavelength of λ=360 degrees.

The plots in FIGS. 1, 3, 4, 12, and 13 are of the power density on the boresight. Of interest is the power density profile of the beam or spot profile across the entire cross-section. This is calculated by adapting the FIG. 11 equation. An example is shown in FIG. 14, which shows the radial power profile at a range of 60 meters for inner disc displacements ranging between ±120° referred to an electrical wavelength, λ=360°. The variation of the displacement greatly affects the profile of the beam. With no displacement, $0.0^0$, the beam profile at 60 meters range as in FIG. 14, has a null at the center, and peaks at a beam radius of about 1.8-m with an amplitude of about 1500 $W/m^2$. When the displacement is on the order of 80° to 120°, the beam profile assumes a central peak and becomes a well formed pencil beam with the intensity concentrated within a radius of about 0.1 m and a peak amplitude of 8500 $W/m^2$ to 9000 $W/m^2$.

A 180° displacement of the disc is equivalent to one half wavelength, or at 100 GHz the value is 1.5-mm. This magnitude of displacement is easily achieved with electromechanical transducers. There are several suitable types of transducer including electromagnetic and piezoelectric types. A typical implementation of the invention would use several transducers, the exact number depending on the size of the inner disc.

When a tilt is introduced to the inner disc position as illustrated in FIG. 8, it affects the beam in that it is no longer rotationally symmetric. The tilting of the disc is easily accomplished by programming the transducers 12 in FIG. 6. The tilt orientation angle 32 in FIG. 8 is also controlled in the same manner and, in addition, a complex combination of displacement, tilt and tilt orientation angle is achievable as a function of time.

The invention claimed is:

1. A mechanism for varying the focal length of an aperture type transmitting antenna having an operating frequency in the microwave band capable of being illuminated externally or internally and of emitting a phase front to form a beam and having a fixed aperture outer rim, the mechanism comprised of:

a. a first flexible microwave antenna aperture plate of equivalent aperture diameter D fixed to said fixed aperture outer rim;

b. a second microwave antenna plate of equivalent aperture diameter of approximately $D/\sqrt{2}$ adjacent, parallel to, and centered on said first aperture plate;

c. a plurality of transducers placed near the outer edge of said second plate, connecting said first and second plate, and capable of linearly displacing said first plate with respect to said second plate;

d. a frame connected to a fixed outer rim of said second plate and to said first plate outer rim, thereby fixing said second plate's position with respect to said first plate; and e. means for commanding the displacement of said transducers to change the displacement between said first and second plates, thereby altering the curvature of said first plate to control the transmitted beam shape, direction, and power density in the Fresnel zone.

2. The mechanism of claim 1, wherein the maximum throw of said transducers is approximately one wavelength of the operating frequency.

3. The mechanism of claim 1, wherein the means of commanding the displacement of said transducers is a controller that receives commands based on a look-up file relating the beam characteristics to the range of interest.

* * * * *